US009027756B2

(12) United States Patent
Yoshifusa

(10) Patent No.: US 9,027,756 B2
(45) Date of Patent: May 12, 2015

(54) STRUCTURE OF INFLATABLE PACKAGING DEVICE

(71) Applicant: Air-Paq, Inc., Las Vegas, NV (US)

(72) Inventor: Kark K Yoshifusa, Lake Forest, CA (US)

(73) Assignee: Air-Paq, Inc., Las Vegas, NV (US)

( * ) Notice: Subject to any disclaimer, the term of this patent is extended or adjusted under 35 U.S.C. 154(b) by 0 days.

(21) Appl. No.: 14/040,387

(22) Filed: Sep. 27, 2013

(65) Prior Publication Data

US 2015/0090627 A1 Apr. 2, 2015

(51) Int. Cl.

| | |
|---|---|
| ***B65D 81/02*** | (2006.01) |
| ***B65D 30/00*** | (2006.01) |
| ***B65D 81/05*** | (2006.01) |

(52) U.S. Cl.

CPC ..... *B65D 81/052* (2013.01)

(58) Field of Classification Search

CPC ..... B65D 81/052; A45C 13/021

USPC ..... 206/453, 522, 586, 591–594; 383/3; 248/345.1

See application file for complete search history.

(56) References Cited

U.S. PATENT DOCUMENTS

| | | | | |
|---|---|---|---|---|
| 4,465,188 | A | 8/1984 | Soroka et al. | |
| 5,857,571 | A | 1/1999 | Tschants et al. | |
| 6,520,332 | B1 | 2/2003 | Barmore et al. | |
| 7,410,057 | B2 * | 8/2008 | Yoshifusa | 206/522 |
| 7,422,108 | B2 | 9/2008 | Yoshifusa | |
| 7,422,109 | B2 * | 9/2008 | Yoshifusa | 206/522 |
| 7,631,762 | B2 * | 12/2009 | Liao et al. | 206/522 |
| 7,938,264 | B2 * | 5/2011 | Yoshifusa | 206/522 |
| 2005/0006271 | A1 | 1/2005 | Nakagawa | |
| 2008/0107362 | A1 * | 5/2008 | Yoshifusa | 383/3 |

* cited by examiner

*Primary Examiner* — Bryon Gehman

(74) *Attorney, Agent, or Firm* — Law Office of Katsuhiro Arai

(57) ABSTRACT

A packaging device includes first and second thermoplastic films superposed with each other, wherein predetermined portions of the thermoplastic films are bonded creating a plurality of fluid containers, a plurality of check valves each connected to a corresponding fluid container, a fluid passage in a first direction connected to the check valves, and a second border between an inflated section including the plurality of fluid containers and an uninflated section, wherein the first and second thermoplastic films are folded and two side edges of the films are bonded and a first portion of a first border connecting the inflated section to a second section is folded and an overlapped portion of the first portion is bonded leaving a remaining portion of the first border unbonded wherein the uninflated section forms a loop, and wherein the uninflated section forming the loop is folded into the inflated section to form a lining.

19 Claims, 13 Drawing Sheets

STRUCTURE OF INFLATABLE PACKAGING DEVICE

CROSS-REFERENCE TO RELATED APPLICATIONS

The present application hereby incorporates by reference the entire technical disclosures of U.S. Pat. Nos. 7,422,108 and 7,938,264.

BACKGROUND OF THE INVENTION

1. Field of the Invention

Embodiments of this invention relate to a structure of a packaging device for use as packing material, and more particularly, to a pocket corner pack device and a pocket end cap device for achieving an improved shock absorbing capability to protect a product from a shock or impact characterized as having an inflated portion and an uninflated lining portion.

2. Description of the Related Art

In product distribution channels such as product shipping, a styrofoam packing material has been used for a long time for packing commodity and industrial products. Although the styrofoam package material has a good thermal insulation performance and a light weight, it has also various disadvantages. For example, recycling the styrofoam is not possible, soot is produced when it burns, a flake or chip comes off when it is snagged because of it's brittleness, an expensive mold is needed for its production, and a relatively large warehouse is necessary to store it.

Therefore, to solve such problems noted above, other packing materials and methods have been proposed. One method is a fluid container of containing a liquid or gas such as air (hereafter also referred to as an "air-packing device"). The air-packing device has excellent characteristics to solve the problems with styrofoam. First, because the air-packing device is made of only thin sheets of plastic films, it does not need a large warehouse to store it unless the air-packing device is inflated. Second, a mold is not necessary for its production because of its simple structure. Third, the air-packing device does not produce a chip or dust which may have adverse effects on precision products. Also, recyclable materials can be used for the films forming the air-packing device. Further, the air-packing device can be produced with low cost and transported with low cost.

FIG. 1 shows an example of structure of conventional air-packing device. The air-packing device 20 includes a plurality of air containers 22 and check valves 24, a guide passage 21 and an air input 25. The air from the air input 25 is supplied to the air containers 22 through the air passage 21 and the check valves 24. Typically, the air-packing device 20 is composed of two thermoplastic films which are bonded together at bonding areas 23*a*.

Each air container 22 is provided with a check valve 24. One of the purposes of having multiple air containers with corresponding check valves is to increase the reliability, because each air container is independent from the others. Namely, even if one of the air containers suffers from an air leakage for some reason, the air-packing device can still function as a shock absorber for packing the product because other air containers are still inflated due to the corresponding check valves.

FIG. 2 is a plan view of the air-packing device 20 of FIG. 1 when it is not inflated which shows bonding areas for closing two thermoplastic films. The thermoplastic films of the air-packing device 20 are bonded (heat-sealed) together at bonding areas 23*a* which are rectangular periphery thereof to air tightly close the air-packing device 20. The thermoplastic films of the air-packing device 20 are also bonded together at bonding areas 23*b* which are boundaries of the air containers 22 to air-tightly separate the air containers 22 from one another.

When using the air-packing device, each air container 22 is filled with the air from the air input 25 through the guide passage 21 and the check valve 24. After filling the air, the expansion of each air container 22 is maintained because each check-valve 24 prevents the reverse flow of the air. The check valve 24 is typically made of two small thermoplastic films which are bonded together to form an air pipe. The air pipe has a tip opening and a valve body to allow the air flowing in the forward direction through the air pipe from the tip opening but the valve body prevents the air flow in the backward direction.

Air-packing devices are becoming more and more popular because of the advantages noted above. There is an increasing need to store and carry precision products or articles which are sensitive to shocks and impacts often involved in shipment of the products. There are many other types of product, such as wine bottles, DVD drivers, music instruments, glass or ceramic wares, antiques, etc. that need special care so as to avoid shocks, vibrations or other mechanical impact. Thus, it is desired that the air-packing device protects the product to minimize any shock or impact. In case the product to be protected has a pointed end, the possibility exists that the air-packing device may be ruptured by it. Thus, it is also desired that the air-packing device does not rupture during transportation.

SUMMARY OF THE INVENTION

It is, therefore, an aspect of embodiments of the present invention to provide a structure of a packaging device for packing a product that can minimize a shock or vibration and protect the product.

It is another aspect of embodiments of the present invention to provide a structure of a packaging device for packing a product by a packing space created by the packaging device unique to a particular product.

It is a further aspect of embodiments of the present invention to provide a structure of a packaging device that has improved durability to prevent rupture of the packaging device caused by a pointed corner of a product.

According to one embodiment of the present invention, a packaging device includes first and second thermoplastic films superposed with each other and extending between a first end and a second end along a first direction, and having a first section close to the first end and a second section close to the second end and connected to the first section at a first border extending perpendicular to the first direction, each section extending along the first direction, wherein predetermined portions of the first and second thermoplastic films in the first and second sections are bonded creating a plurality of fluid containers, a plurality of check valves each connected to a corresponding fluid container, a fluid passage extending along the first direction and connected to the check valves, wherein the plurality of fluid containers comprise a second border between an inflated section comprising the plurality of fluid containers and an uninflated section, the second border extending in the first direction, wherein the first and second thermoplastic films are folded and two side edges of the films are bonded and a first portion of the first border connecting the inflated section of the first section to the second section is folded and an overlapped portion of the first portion is bonded with each other leaving a remaining portion of the first border unbonded wherein the uninflated section forms a loop, and wherein the uninflated section forming the loop is folded into the inflated section to form a lining.

In one aspect of the above embodiment, at least one fluid container is positioned below a bottom portion of the lining.

In one aspect of the above embodiment, the plurality of fluid containers extend in a direction parallel to an insertion direction of a product to be held.

In another aspect of the above embodiment, the second section of the packaging device includes at least one inflated fluid container providing an extra protection to a side of the packaging device.

In yet another aspect of the above embodiment, one end of the loop in the packaging device may be bonded to further prevent, for example, direct contact to the inflated section by the product.

In still another aspect of the above embodiment, the fluid container of the packaging device may contain a gas or fluid.

In yet another aspect of the above embodiment, the packaging device further includes a plurality of heat-seal lands each bonding the first and second thermoplastic films in an area of the fluid container to create a plurality of series connected cells in the fluid container, the heat-seal lands are positioned in the fluid container in a manner to allow a fluid flow between the cells.

According to another embodiment of the present invention, a packaging device includes first and second thermoplastic films superposed with each other and extending between a first end and a second end along a first direction, and having a first side section close to the first end and connected to a middle section at a first side border and a second side section close to the second end connected to the middle section at a second side border, each section extending along the first direction, wherein predetermined portions of the first and second thermoplastic films in the first, middle and second sections are bonded creating a plurality of fluid containers extending in a direction perpendicular to the first direction, a plurality of check valves each connected to a corresponding fluid container, a fluid passage extending along the first direction and connected to the check valves, wherein the plurality of fluid containers include a third border between an inflated section including the plurality of fluid containers and an uninflated section, the third border extending in the first direction, wherein the first and second thermoplastic films are folded and two side edges of the films are bonded and a first portion of the first border connecting the inflated section of the first section to the middle section and a second portion of the second border connecting the inflated section of the second section to the middle section are folded and an overlapped portion of each of the first and second portions is bonded with each other leaving a remaining portion of each of the first and second borders unbounded wherein the uninflated section forms a loop, and wherein the uninflated section forming the loop is folded into the inflated section to form a lining.

According to various embodiments of the present invention, the packaging device can minimize the shocks or vibrations to a product when the product is dropped or collided. The packaging device includes the plurality of fluid containers each having a plurality of cells connected in series. After being inflated, for example, by compressed air, the lining formed by the uninflated section of the packaging device. The uninflated section of the packaging device acts as a lining that holds a product to be protected, while the lining helps prevent rupture of the fluid containers by preventing direct contact of the product to the inflated section.

DETAILED DESCRIPTION

The packing device according to various embodiments of the present invention will be described in more detail with reference to the accompanying drawings. It should be noted that although various embodiments are described for the case of using an air for inflating the packing device for an illustration purpose, other fluids such as other types of gas or liquid can also be used. The packing device is typically used in a container box to pack a product during the distribution channel of the product.

The packing device according to an embodiment of the present invention is especially useful for packing products which are sensitive to shock or vibration such as hard disk drives, personal computers, DVD drivers, bottles, glassware, ceramic ware, music instruments, paintings, antiques, etc. The packaging device reliably holds the product within a lining area of the packaging device to secure the product to be protected. As a lining in the lining area prevents the product to directly touch an air container cushioning the product, rapture of the air container in turn is prevented also. The product and the packaging device are then placed in a container box. Thus, the packaging device absorbs the shocks and impacts applied to the product when, for example, the product is inadvertently dropped on the floor or collided with other objects.

The packaging device of the present embodiments includes a plurality of air containers each having a plurality of serially connected cells, and an uninflated portion that acts as a lining to hold a product. The air container is air-tightly separated from the other air containers while the cells in the same air container are connected by the air passages such that the air can flow among the cells through the air passages. Each cell in the air container has a sausage like shape when air fills in the air containers. The air containers are formed even below the bottom of the lining to insure protection to the product. In addition, the air containers are aligned in a manner so that the product to be held can be inserted in a direction parallel to the direction the air containers are aligned for an easy insertion. Depending on needs, extra air containers may be formed next to a container portion of the packaging device as will be described later.

Figure 1:
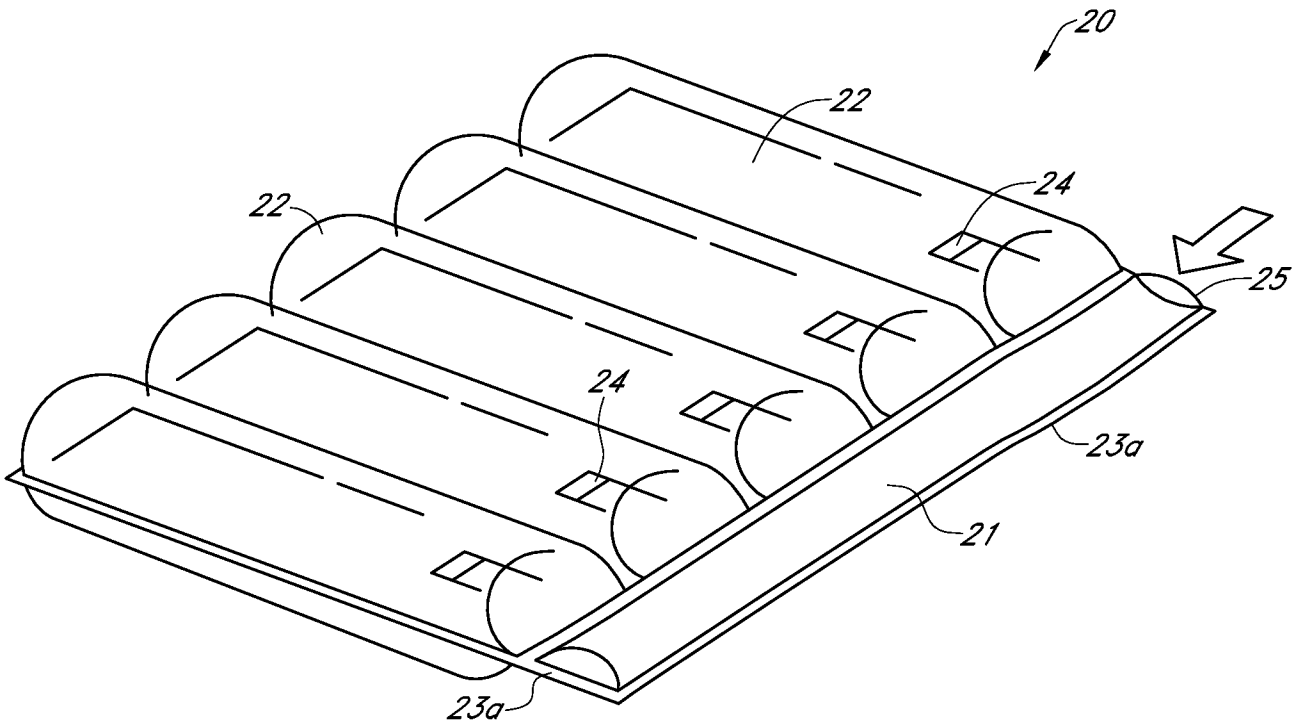
FIG. 1 (PRIOR ART)
FIG. 1 is a schematic perspective view showing an example of basic structure of conventional air-packing device.
Figure 2:
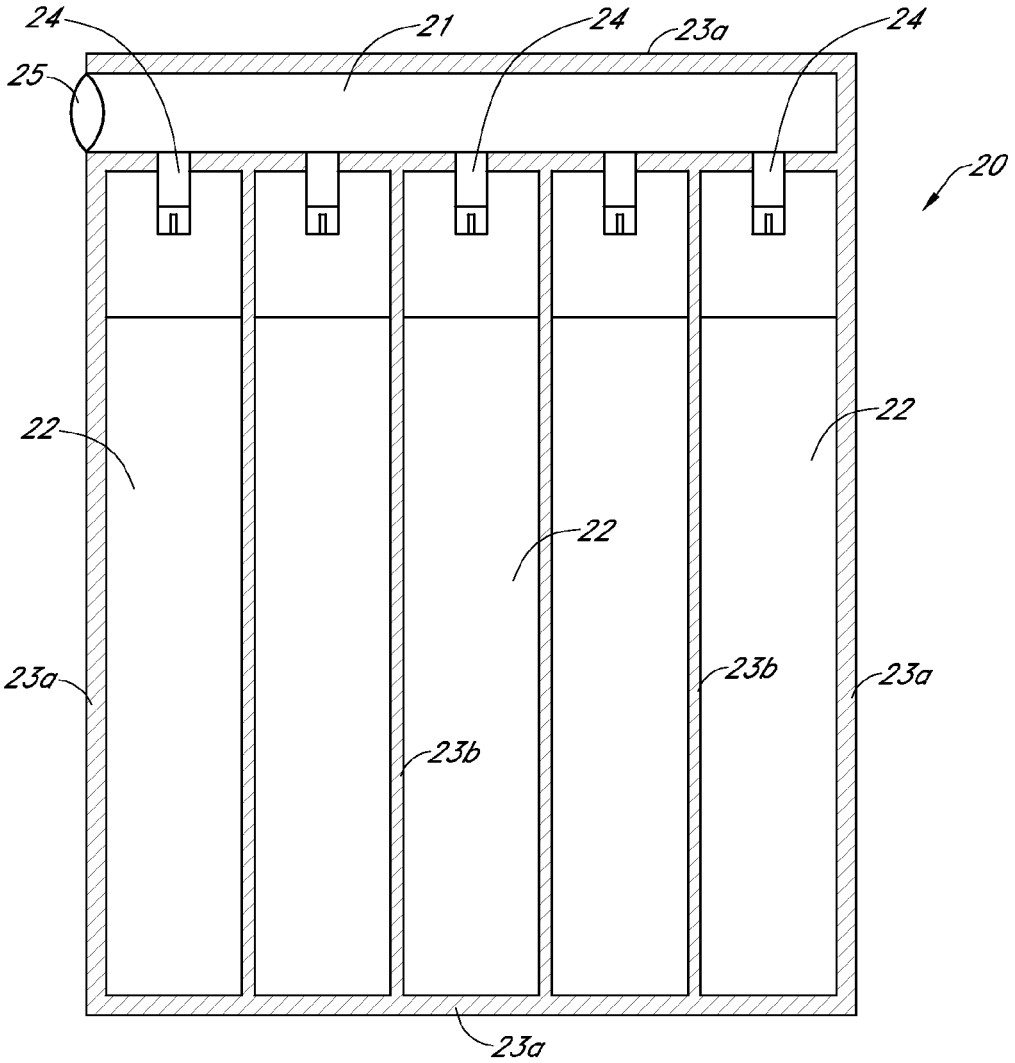
FIG. 2 (PRIOR ART)
FIG. 2 is a plan view of the air-packing device 20 of FIG. 1 when it is not inflated for showing bonding areas for closing two thermoplastic films.
Figure 3:
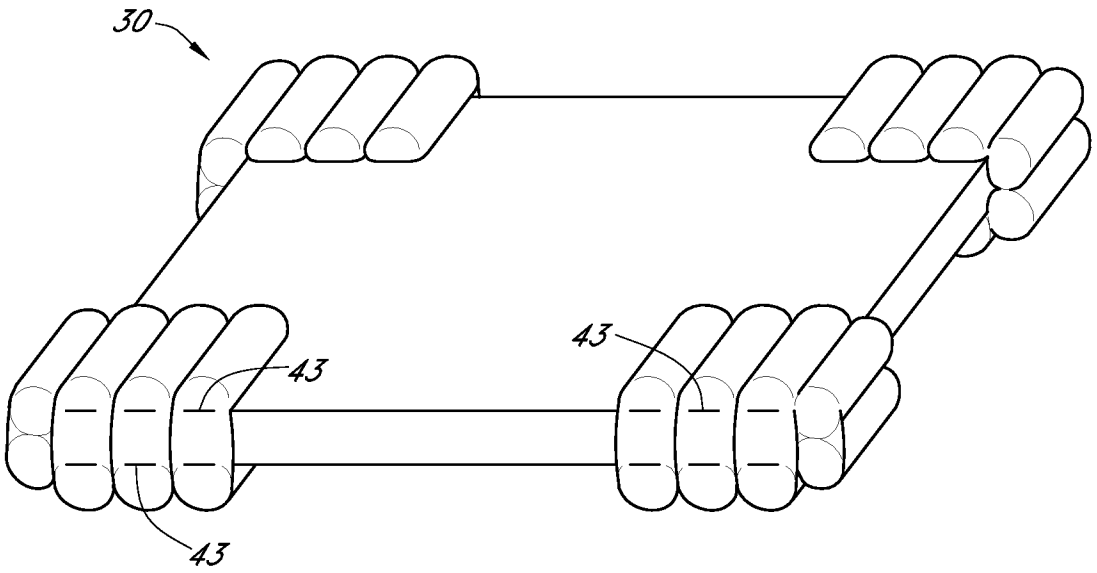
FIG. 3 is a perspective view of four packaging devices according to a first embodiment of the present invention and a product that is securely held by a lining and by a plurality of air containers in each of the four packaging devices for protection.

One embodiment of the present invention is described with reference to FIGS. 3 to 9. FIG. 3 is a perspective view showing each of four packaging devices 30 holding each corner of a product to be protected (hard disk drive) for shock absorption. Normally, the hard disk drive and the packaging devices 30 are placed in a container box, such as a corrugated carton, for transportation. Although there are many different types of hard disk drives with different shapes and sizes, the packaging devices 30 of the present embodiment can accommodate all of the types of hard disk drives because of its flexibility, especially, a location of heat-seal lands 43 where an air container can be easily bent can be freely determined.

Figure 4:
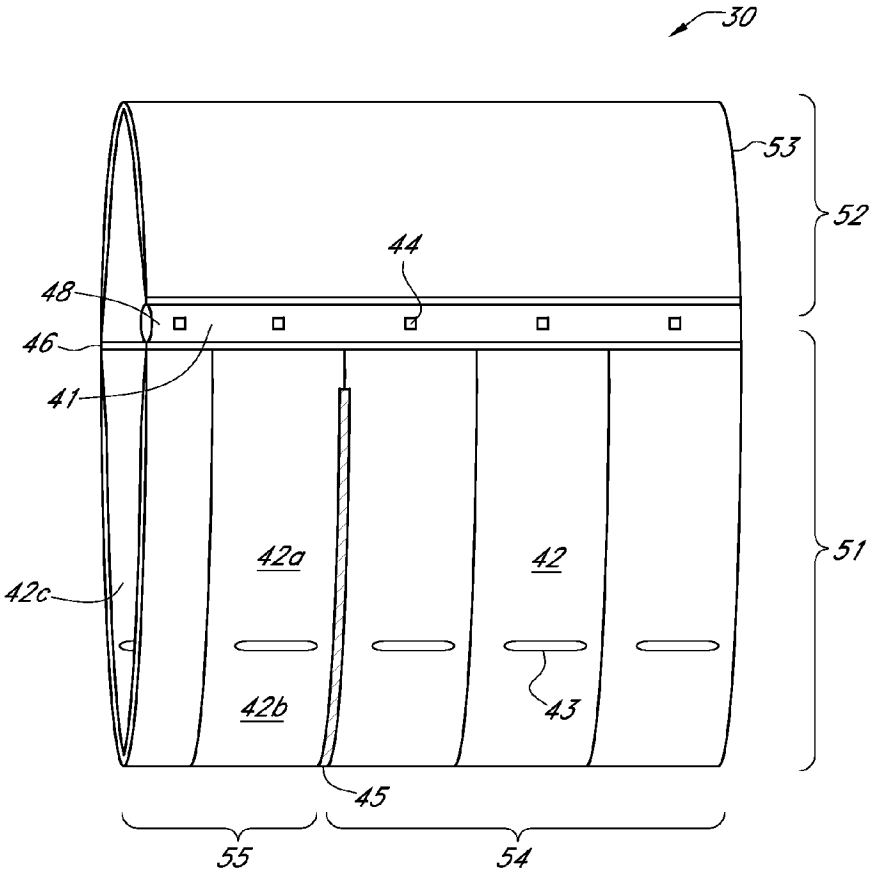
FIG. 4 is another perspective view of the packaging device of FIG. 3 wherein the packaging device is not inflated.

FIG. 4 is another perspective view showing the packaging device 30 of the present embodiment before being inflated, for example, by a compressed air. This configuration is especially suited to hold and protect a flat rectangular shaped product. However, it should be noted that any number of these packaging devices 30 can be used to protect a product with any number of corners. An actual example of using the packaging devices 30 is shown in the perspective view of FIG. 3, in which four packaging devices 30 hold a product such as a hard disk drive by its corners.

Figure 5:
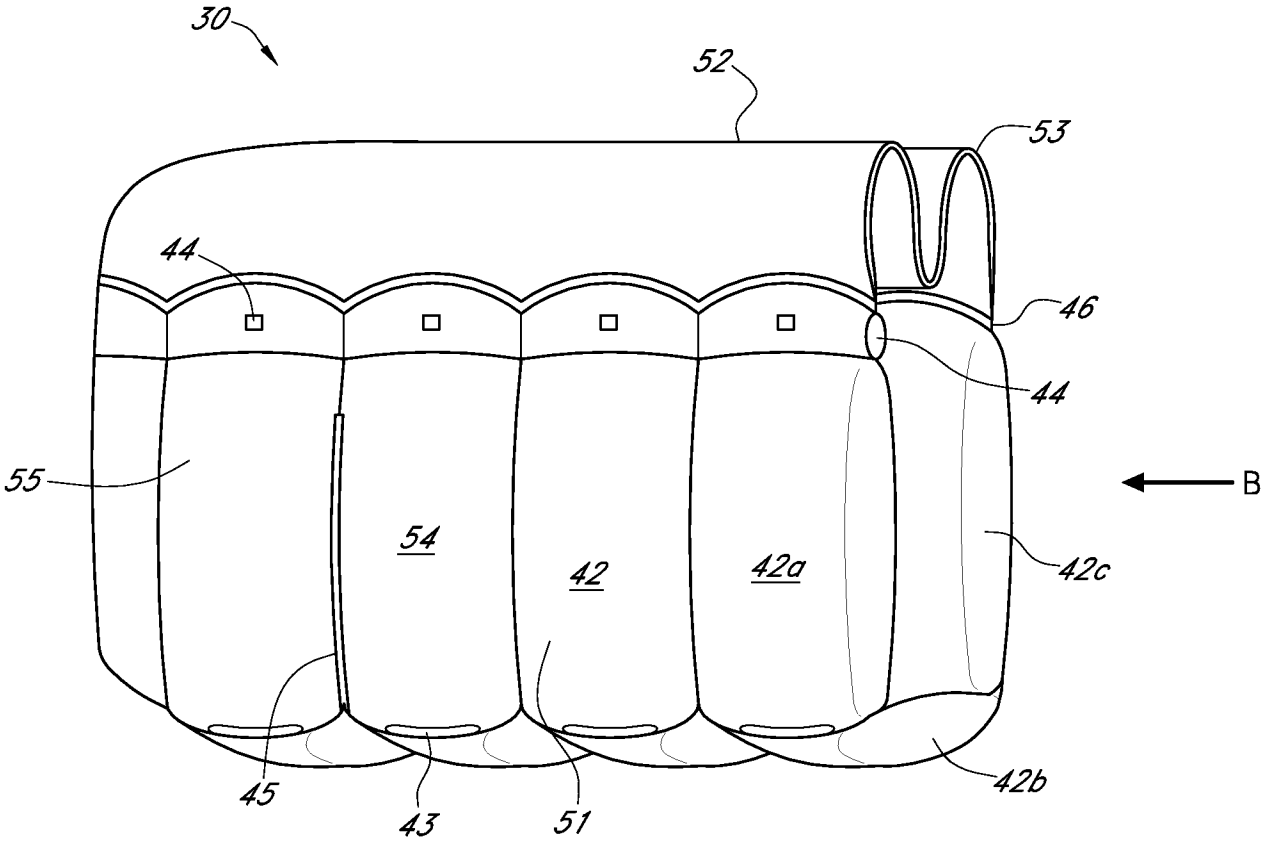
FIG. 5 is a perspective view of the packing device of FIG. 4 wherein the packing device has an inflated portion and uninflated portion forming a loop.

Referring to FIG. 4 and FIG. 5, the packaging device 30 is made of two thermoplastic films which are bonded (heat-sealed) together to create a plurality of air containers 42 in an inflated portion 51. Such bonded areas air-tightly separate the air containers 42 from one another. The inflated portion 51 is divided into a container portion 54 and a side portion 55. The container portion 54 is connected to the side portion 55 at a vertical border 45. The packaging device 30 further includes an uninflated portion 52 connected to the inflated portion 51 at a horizontal border 46. The vertical border 45 is formed between the container portion 54 and the side portion 55 from near an air passage 41 to the horizontal border 46 extending in a vertical direction. Top and bottom edges of the packaging device 30 are bonded near the air passage 41 so that the packaging device 30 forms a loop. More specifically, in FIG. 4, a part of the vertical border 45 that overlaps between front and back sides is bonded, whereas the uninflated portion 52 is not bonded between the front and back sides and forms the loop. In the packaging device 30, each air container 42 may have a plurality of serially connected cells 42*a*-42*c*. In FIG. 4, as described above, the packaging device is folded and the top edge and the bottom edge are bonded with each other along the air passage 41 to form the loop as will be explained later in detail.

The cells 42*a*-42*c* of the air container 42 connected in series are created by bonding (heat-sealing) the two thermoplastic films of the air container 42 at each small heat-seal land (separator) 43. The heat-seal lands 43 are small area on the air container 42 and do not completely separate the adjacent cells 42*a*-42*c*. Thus, two small air passages (left side and right side of the heat-seal land 43) are created for allowing the air to flow therethrough toward the next cell. The heat-seal lands 43 are provided to create the cells 42*a*-42*c* as well as to define locations for folding the packaging device 30. In other words, the locations of the heat-seal lands 43 are uniquely arranged to create a specific shape of the packaging device 30 when wrapping a product. Any number of heat seal lands 43 can be created within the air container 42 to create a specific shape.

Typically, each air container 42 is provided with a check valve 44 at one end so that the air is maintained in the air container 42 because the check valve 44 prohibits a reverse flow of the air. In the example of FIG. 4, the check valves 44 are provided near the top edge of the packaging device 30 and are commonly connected to the air passage 41. When the air is supplied through the air passage 41, the air flows through the check valves 44 and inflates all of the cells 42*a*-42*c*.

In a variation of the present embodiment, the air introduced from the air passage 41 may be blocked by an optional air stopper 48 at an end of the air passage 41 where the films are bonded with each other. The air may be introduced to the air passage 41 from the other end which is open and will flow to each of the air containers.

The air containers 42 in the inflated portion 51 are filled with the air while the uninflated portion 52 is not inflated. Thus, the uninflated portion 52 does not act as a cushion but will act as a lining 53 to hold a product to be protected as will be explained later in detail. It should be noted that because the uninflated portion 52 does not act as a cushion, it is unnecessary to form an air container which is inflated by the air. However, to produce the packaging device 30 of the present embodiment through a standard production machine, the air containers and/or check valves may be formed in the same manner throughout the thermoplastic films.

The top edge and the bottom edge of the packaging device 30 are bonded to form the loop as described above and as show in FIG. 4. Thus, when the air packing device 30 is filled with compressed air, the air packing device 30 takes the shape shown in the perspective view of FIG. 5. As shown, the packaging device 30 has an inflated portion 51 and the uninflated portion 52 forming the lining 53 that is not inflated because of the horizontal border 46 which prevents the flow of air to the uninflated portion 51 as shown in FIG. 4.

The inflated portion 51 is made of a plurality of air containers 42 in the container portion 54 and the side portion 55 that are filled with the compressed air and forms a structure in which the air containers 42 are aligned in the same direction as the vertical border 45 with at least one side open. This alignment of the air containers 42 may facilitate the insertion of a product to be held. In this example, the inflated portion 51 forms a substantially rectangular shape with a top and a side not covered with the air containers 42. The side portion 55 of the structure is formed along the vertical border 45 where the container portion 54 and the side portion 55 are connected as shown in FIG. 4. The side portion 55 can accommodate any number of air containers to provide an extra protection as well as to adjust the size of the packaging device 30 so that it fits into a container box. Two corners of the structure are formed near the heat-seal lands 43 because the heat-seal lands 43 promote to form a bent corner in the air containers 42 in the packaging device 30.

The uninflated portion 52 itself does not have the capacity to absorb shocks because it is not filled with the compressed air. However, the uninflated portion 52 is folded into the open part of the structure formed by the inflated portion 51 to form the lining 53 within the structure. In addition, the air containers 42 of the inflated portion 51 are formed even underneath the bottom portion of the lining 53 to further protect the product. Therefore, the lining 53 is suitable to securely hold a product to be protected. It should be noted that the thermoplastic films of the lining 53 may also be bonded to form an air container, so that the lining 53 is reinforced thereby having a sufficient physical strength with respect to the product received therein.

Figure 6:
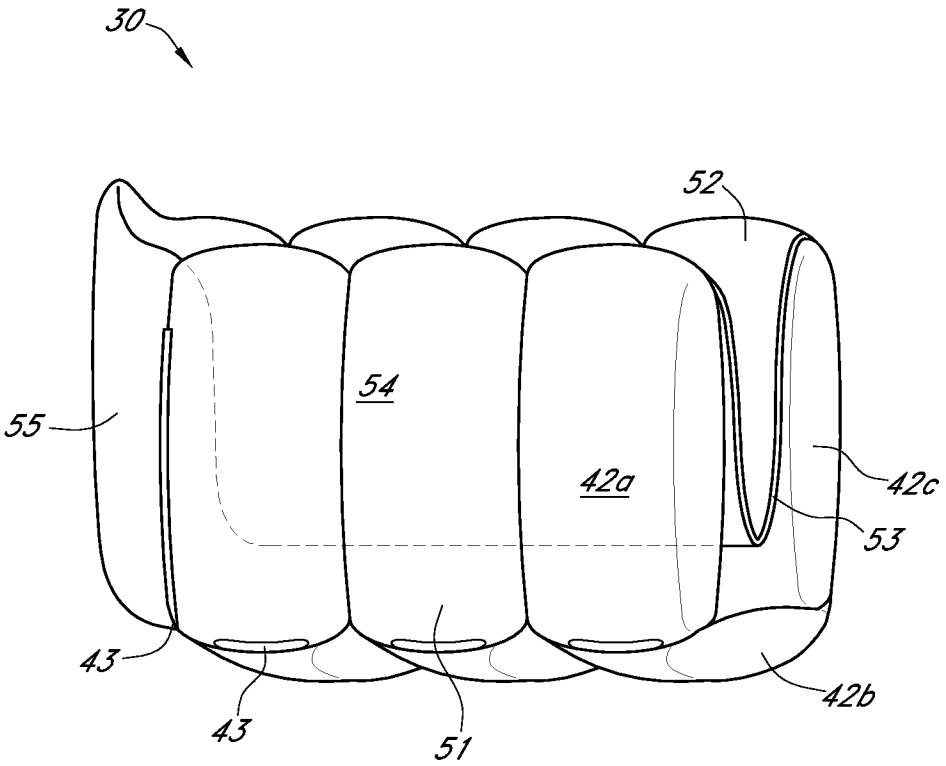
FIG. 6 is a perspective view of the packing device wherein the packing device has the inflated portion and the uninflated portion forming the loop that has been folded into the inflated portion to form a lining.

Referring to a perspective view shown in FIG. 6, the condition of the packaging device 30 wherein the uninflated portion 52 is folded inside to make the lining 53 is described. In other words, FIG. 6 shows the perspective view of the packaging device observed from a side (arrow B) of FIG. 5. As shown, the uninflated portion 52 is folded inside to make the lining 53. The position of the horizontal border 46 (FIG. 4) is so selected that the bottom of the lining 53 remains within the structure formed by the inflated portion 51. One corner of a product to be protected, such as a hard disk drive, is inserted into the lining 53 and contact the bottom of the lining 53. Here, in addition to the air containers 42 being positioned on each side of the hard disk drive, there is at least one air container 42 of the inflated portion 51 positioned directly below the bottom of the lining 53 to further protect the hard disk drive.

The lining 53 can stabilize the position of the product to be protected because the air containers 42 are positioned directly below the bottom of the lining 53 to cushion the product. Moreover, the lining 53 prevents the product from direct contact with the inflated portion 51. Namely, when the product is inserted into the lining 53, the end of the product which sometimes has a sharp edge or corner will not directly touch the inflated portion 51 which includes the cells 42*a*-42*c* of the air container 42 that is filled with compressed air. This prevents breakage or puncture of the packaging device 30. In the present embodiment, the lining 53 is made of two sheets of films heat-sealed with one another as noted above, thus, the durability of the packaging device 30 is enhanced. Thus, the lining 53 increases the reliability of the packaging device 30.

Figure 7:
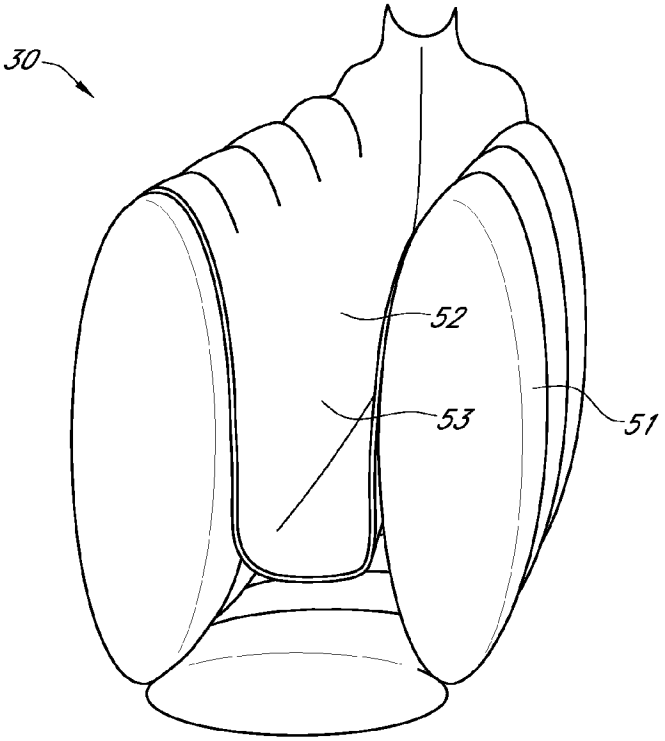
FIG. 7 is a frontal view of the packing device viewed from a front side of the packing device that receives a product to be protected.

FIG. 7 is a front view of the lining 53 of the packaging device 30 as depicted in FIG. 6. The lining 53 is surrounded by the inflated portion 51 that protects the product to be protected because of the cushion function. As noted above, in an actual application, for example, four packaging devices 30 may be used to hold a flat rectangular shaped product, each at each corner for protection. Then, the four packaging devices 30 packing the product therein is installed in a container box made of hard paper, corrugated fiber board, etc., commonly used in the industry.

Figure 8:
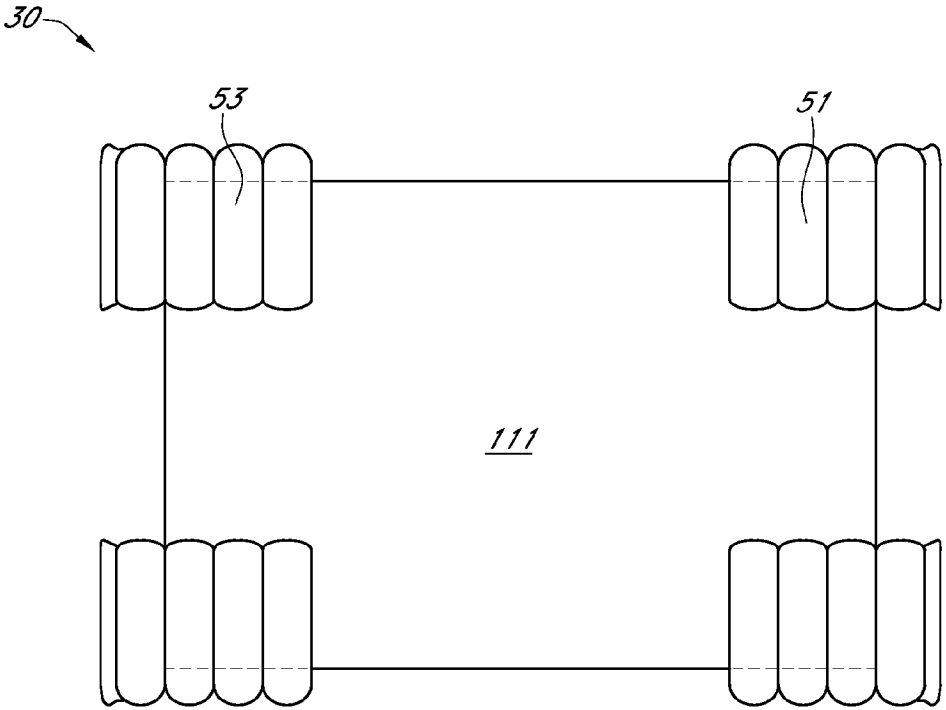
FIG. 8 is a top view of four packing devices according to the first embodiment that are used to protect a package.

FIG. 8 is a top view showing each of the four packaging devices 30 holding the product 111 such as a hard disk drive by each corner. The configuration within the packaging devices 30 is indicated by dotted lines. As shown, the product 111 is securely held by the packaging devices 30 provided at four corners of the product 111. The corner of the product 111 is packed by the lining 53 and the inflated portion 51. As the packaging device 30 completely surrounds each corner of the product 111, it can absorb the shocks and impacts from any direction.

Another embodiment of the present invention is described with reference to FIGS. 9 to 13. Similar to the previous embodiment, the packaging device in this embodiment is basically configured by the inflated portion and the lining portion. The lining portion is configured so as not to be inflated by the compressed air and is folded inside of the inflated portion. This configuration can be advantageously used for protecting a product that has relatively flat and rectangular object, such as a notebook computer, DVD driver, etc.

Figure 9:
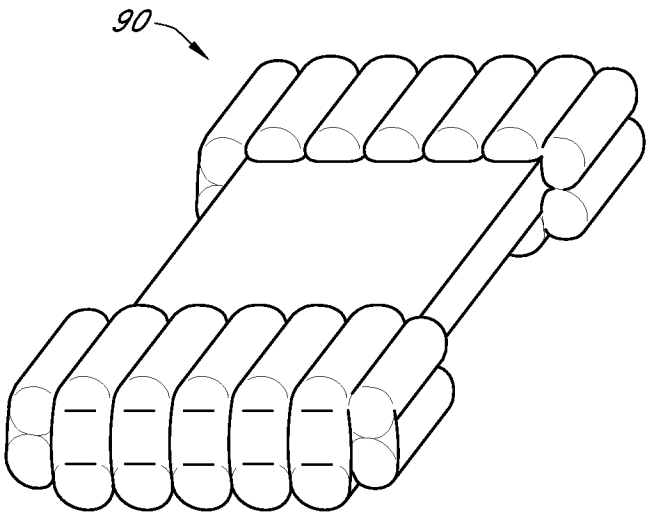
FIG. 9 is a perspective view of two packing devices according to a second embodiment of the present invention and a product that is securely held by a lining and a plurality of air containers of each of the packaging devices for protection.

FIG. 9 is a perspective view similar to that shown in FIG. 3 except that the packaging devices 90 cover the ends of the product to be protected, for example, a notebook computer for shock absorption. Normally, the notebook computer and the packaging devices 90 are placed in a container box, such as a corrugated carton, for transportation.

Figure 10:
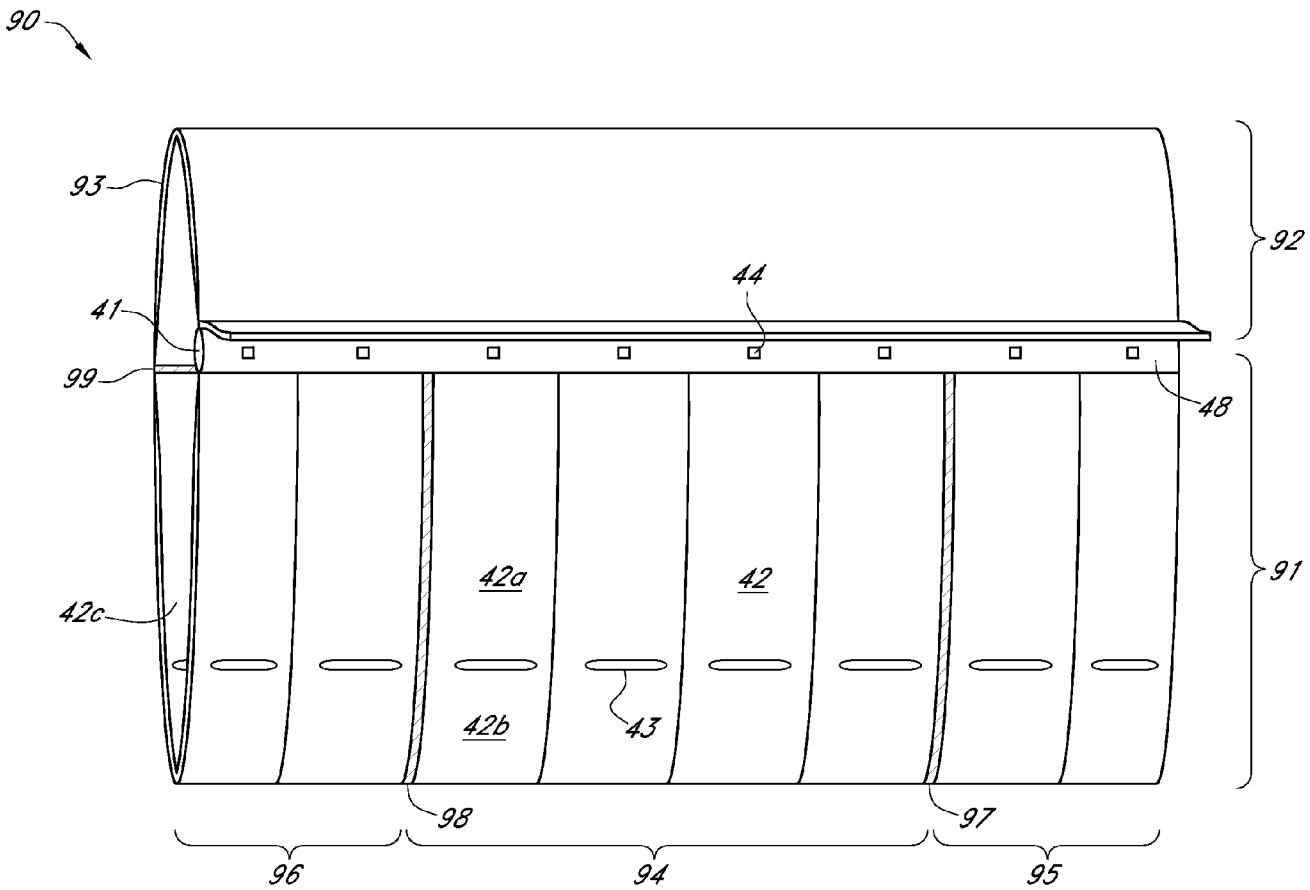
FIG. 10 is another perspective view of the packaging device of FIG. 9 wherein the packaging device is not inflated.

FIG. 10 is another perspective view showing the packaging device 90 of the present embodiment before being inflated by the air. It should be noted that this packaging device 90 can be used in a pair to protect a product. An example of actual use of the packaging device 90 is shown in the perspective view of FIG. 9, wherein a pair of packaging devices 90 holds a product such as a notebook computer.

Figure 11:
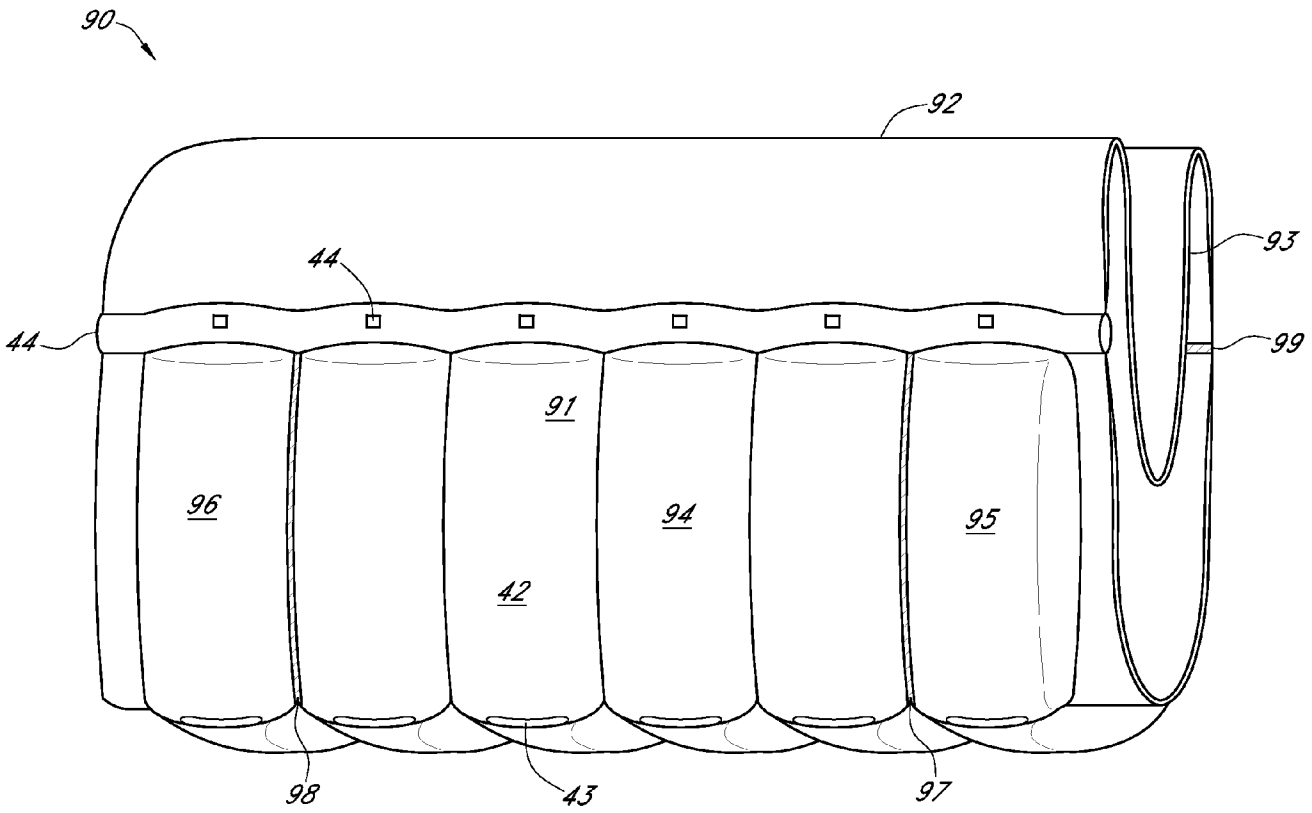
FIG. 11 is a perspective view of the packing device of FIG. 9 wherein the packing device has an inflated portion and uninflated portion forming a loop.

Referring to FIG. 10 and FIG. 11, the packaging device 90 is made of two thermoplastic films which are bonded (heat-sealed) together to create the plurality of air containers 42 in an inflated portion 91. Such bonded areas air-tightly separate the air containers 42 from one another. The inflated portion 91 is divided into a middle portion 94, a first side portion 95 and a second side portion 96. The middle portion 94 is connected to the first side portion 95 and the second side portion 96 at a first side border 97 and at a second side border 98 respectively. The packaging device 90 further includes an uninflated portion 92 connected to the inflated portion 91 at a horizontal border 99. The first and second side borders 97 and 98 are formed between the middle portion 94 and the first side portion 95 and between the middle portion 94 and the second side portion 96 respectively from near an air passage 41 to the horizontal border 99 extending in a vertical direction. Top and bottom edges of the packaging device 90 are bonded near the air passage 41 to form a loop. More specifically, in FIG. 10, a part of each of the first and second side borders 97 and 98 that overlaps between front and back sides is bonded whereas the uninflated portion 92 is not bonded between the front and back sides and forms the loop. In the packaging device 90, each air container 42 may have a plurality of serially connected cells 42*a*-42*c*. Typically, each air container 42 is provided with a check valve 44 at one end so that the compressed air is maintained in the air container 42 because the check valve 44 prohibits a reverse flow of the air.

In the example of FIG. 10, the check valves 44 are provided near the top edge of the packaging device 90 where the top and bottom edges of the packaging device 90 are connected to form the loop and are commonly connected to the air passage 41. When the compressed air is supplied through the air passage 41, the air flows through the check valves 44 and inflates all of the air containers 42. The air introduced from the air passage 41 may be blocked by an optional air stopper 48 at one end of the air passage 41, where the thermoplastic films are bonded with each other, thereby closing the air passage 41. In this case, the other end of the air passage 41 can be used to introduce the air.

The air containers 42 in the inflated portion 91 are filled with the air while the uninflated portion 92 is not inflated. Thus, the uninflated portion 92 does not act as a cushion but will act as a lining 93 to hold a product to be protected as will be explained later in detail. It should be noted that because the uninflated portion 92 does not act as a cushion, it is unnecessary to form an air container to be inflated by the air. However, to produce the packaging device 90 of the present embodiment through a standard production machine, air containers and/or check valves may be formed in the same manner throughout the thermoplastic films.

The top edge and the bottom edge of the packaging device 90 are bonded to form the loop as described above and as show in FIG. 10. Thus, when the air packing device 90 is filled with compressed air, the air packing device 90 takes the shape shown in the perspective view of FIG. 11. As shown, the packaging device 90 has an inflated portion 91 and the uninflated portion 92 forming the lining 93 that is not inflated because of the horizontal border 99 which prevents the flow of air to the uninflated portion 91 as also shown in FIG. 10. The packaging device 90 can be bent at around the middle of the air containers 42 when the air is appropriately filled therein. It is also feasible to provide a heat-seal land 43 (separator) such as shown in FIG. 10 and FIG. 11 to facilitate folding of the packaging device 90 to form a flat bottom with two corners formed where the heat seal lands 43 are located.

The inflated portion 91 is made of a plurality of air containers 42 in the middle, first side, and second side portions that are filled with the compressed air and forms a structure in which the air containers 42 are aligned in the same direction as the first and second side borders 97 and 98 with a top portion open. This alignment of the air containers 42 may facilitate the insertion of a product to be held. In this example, the inflated portion 91 forms a substantially rectangular shape with the top not covered with the air containers 42. Each of the first and second side portions 95 and 96 of the structure is formed along the first and second side borders 97 and 98 respectively where the middle portion 94 and each of the first and second side portions 95 and 96 are connected as shown in FIG. 10. Each of the first and second side portions 95 and 96 can accommodate any number of air containers to provide an extra protection as well as to adjust the size of the packaging device 90 so that it fits into a container box.

As shown in FIG. 11, the packaging device 90 has an inflated portion 91 formed with the air containers 42 and an uninflated portion 92 that is not filled with the air. The uninflated portion 92 itself does not have the capacity to absorb the shocks and impacts because it is not filled with the air. However, the uninflated portion 92 is folded and inserted in the inflated portion 91 to make the lining 93 that is suitable to hold a product to be protected. In addition, the air containers 42 of the inflated portion 91 are formed even underneath the bottom portion of the lining 93 to further protect the product. In this example, the inflated portion 91 has a substantially thin rectangular structure.

Figure 12:
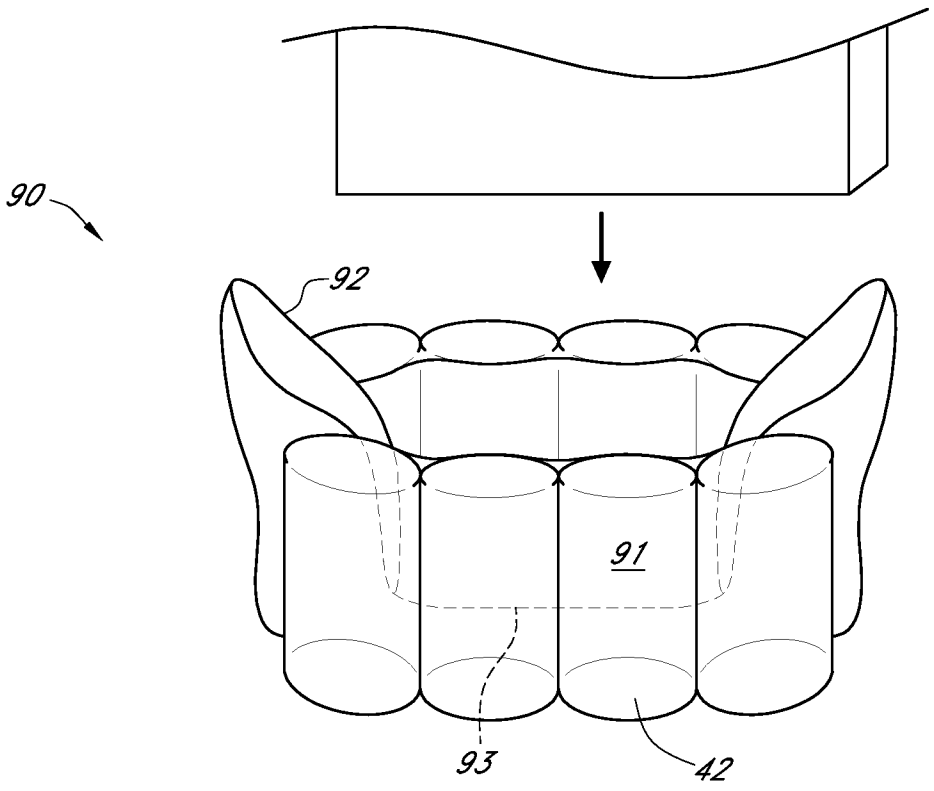
FIG. 12 is a perspective view of the packing device wherein the packing device has the inflated portion and the uninflated portion forming the loop that has been folded into the inflated portion to form a lining.

Referring to the perspective view shown in FIG. 12, the condition of the packaging device 90 wherein the uninflated portion 92 has been folded inside to make the lining 93 (shown as dotted line) is described. The uninflated portion 92 which is not provided with the compressed air is folded inside within the space of the inflated portion 91 to form the lining 93. One end of a product to be protected, such as a notebook computer, is inserted into the lining 93 and contacts the bottom of the lining 93. The lining 93 can stabilize the position of the product to be protected because there are air containers 42 positioned directly below the bottom of the lining 93 to cushion the product within the inflated portion 91.

Moreover, the lining 93 prevents direct contact of the product with the inflated portion 91. When the product is inserted in the lining 93, the product will not directly touch the air container 42 of the inflated portion 91 that is filled with compressed air. Although a product may have a relatively sharp edge or corner, since such a sharp part of the product will not contact the inflated portion 91 directly because of the lining 93, the packaging device 90 will not be easily punctured by the product.

In the present embodiment example, the uninflated portion 92 is made of two sheets of thermoplastic films which may be heat-sealed by the same pattern as that of the inflated portion 91. Thus, the uninflated portion 92 reinforced in this manner is used for the lining 93, the durability of the packaging device 90 will be increased as the product does not directly touch the inflated portion 91. Thus, the lining 93 increases the reliability of the packaging device 90.

Figure 13:
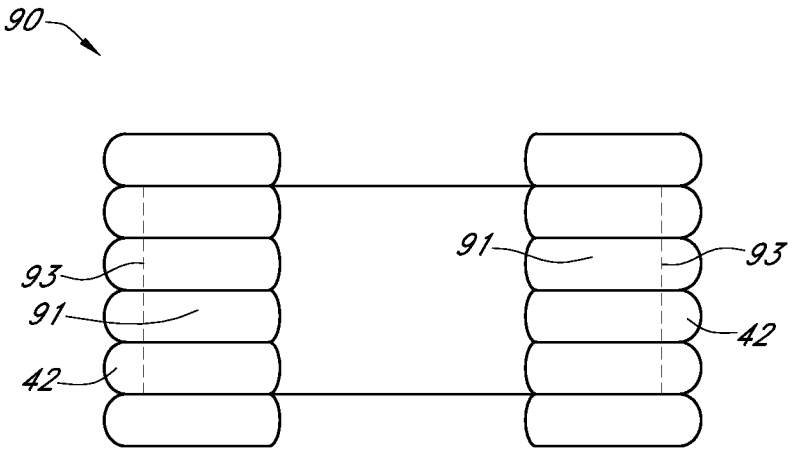
FIG. 13 is a plan view of two packing devices according to the second embodiment that are used to protect a package.

FIG. 13 is a top view showing a pair of packaging devices 90 that are aligned in the same condition as that when the packaging devices 90 are used to hold a product to be protected. The packaging device 90 on the left shows the inflated portion 91 and the lining 93 inside the inflated portion 91. The packaging device 90 on the right shows the inflated portion 91 and the lining 93 inside the inflated portion 91. It should be noted that the bottom of the lining 93 is directly above air containers 42 so that the bottom of the lining 93 will not contact the container box when installed therein.

Although various embodiments of the present invention are described herein, one skilled in the art will readily appreciate that various modifications and variations may be made without departing from the spirit and the scope of the present invention. Such modifications and variations are considered to be within the purview and scope of the appended claims and their equivalents.

What is claimed is:

1. A packaging device comprising:

first and second thermoplastic films superposed with each other and extending between a first end and a second end along a first direction, and having a first section close to the first end and a second section close to the second end and connected to the first section at a first border extending perpendicular to the first direction, each section extending along the first direction, wherein predetermined portions of the first and second thermoplastic films in the first and second sections are bonded creating a plurality of fluid containers;

a plurality of check valves connected to the plurality of fluid containers, respectively;

a fluid passage extending along the first direction and connected to the check valves; and a second border between an inflated section comprising the plurality of fluid containers and an uninflated section, the second border extending in the first direction;

wherein the first and second thermoplastic films are folded and top and bottom edges of the films are bonded and a first portion of the first border connecting the inflated section of the first section to the second section is folded and an overlapped portion of the first portion is bonded leaving a remaining portion of the first border unbonded wherein the uninflated section forms a loop; and wherein the uninflated section forming the loop is folded into the inflated section to form a lining.

2. The packaging device of claim 1, wherein at least one of the plurality of fluid containers is positioned below a bottom portion of the lining.

3. The packaging device of claim 1, wherein the plurality of fluid containers extend in a direction parallel to an insertion direction of a product to be held.

4. The packaging device of claiml, wherein the second section comprises at least one of the plurality of fluid containers.

5. The packaging device of claim 1, wherein one end of the loop is bonded.

6. The packaging device of claim 1, wherein each fluid container may contain a gas or fluid.

7. The packaging device of claim 1, wherein the fluid passage extends between the first end and the second end, and has a stopper at the second end.

8. The packaging device of claim 7, wherein the stopper is formed by bonding a portion of the first and second thermoplastic films in the fluid passage.

9. The packaging device of claim 1, further comprising a plurality of heat-seal lands each bonding the first and second thermoplastic films in an area of each fluid container to create a plurality of series connected cells in each fluid container, the heat-seal lands are positioned in each fluid container in a manner to allow a fluid flow between the cells.

10. The packaging device as defined in claim 1, wherein the inflated section has a substantially rectangular shape when inflated.

11. A packaging device comprising:

first and second thermoplastic films superposed with each other and extending between a first end and a second end along a first direction, and having a first side section close to the first end and connected to a middle section at a first side border and a second side section close to the second end connected to the middle section at a second side border, each section extending along the first direction, wherein predetermined portions of the first and second thermoplastic films in the first, middle and second sections are bonded creating a plurality of fluid containers extending in a direction perpendicular to the first direction;

a plurality of check valves connected to the plurality of fluid containers, respectively;

a fluid passage extending along the first direction and connected to the check valves; and a third border between an inflated section comprising the plurality of fluid containers and an uninflated section, the third border extending in the first direction;

wherein the first and second thermoplastic films are folded and top and bottom edges of the films are bonded and a first portion of the first side border connecting the inflated section of the first side section to the middle section and a second portion of the second side border connecting the inflated section of the second side section to the middle section are folded and an overlapped portion of each of the first and second portions is bonded leaving a remaining portion of each of the first and second side borders unbonded wherein the uninflated section forms a loop; and wherein the uninflated section forming the loop is folded into the inflated section to form a lining.

12. The packaging device of claim 11, wherein at least one of the plurality of fluid containers is positioned below a bottom portion of the lining.

13. The packaging device of claim 11, wherein the plurality of fluid containers extend in a direction parallel to an insertion direction of a product to be held.

14. The packaging device of claim 11, wherein each of the first and second side sections comprises at least one of the plurality of fluid containers.

15. The packaging device of claim 11, wherein the lining covers at least one of the plurality of fluid containers in the middle section.

16. The packaging device of claim 11, wherein each fluid container may contain a gas or fluid.

17. The packaging device of claim 11, wherein the fluid passage extends between the first end and the second end, and has a stopper at the second end.

18. The packaging device of claim 17, wherein the stopper is formed by bonding a portion of the first and second thermoplastic films in the fluid passage.

19. The packaging device of claim 11, further comprising a plurality of heat-seal lands each bonding the first and second thermoplastic films in an area of each fluid container to create a plurality of series connected cells in each fluid container, the heat-seal lands are positioned in each fluid container in a manner to allow a fluid flow between the cells.

* * * * *